US005371658A

United States Patent [19]

Christie

[11] Patent Number: 5,371,658

[45] Date of Patent: Dec. 6, 1994

[54] BROKEN LIGHT BULB BASE REMOVAL TOOL

[76] Inventor: Brian L. Christie, 325 Paisley Ave., Hemet, Calif. 92543

[21] Appl. No.: 99,471

[22] Filed: Jul. 30, 1993

[51] Int. Cl.[5] ..... F21V 33/00; B25B 7/12

[52] U.S. Cl. ..... 362/109; 362/119; 362/120; 81/302; 81/416; 81/427.5

[58] Field of Search ..... 362/109, 119, 120; 81/300, 314, 315, 318, 322, 336, 337, 340, 418, 421, 426, 427.5, 302, 416

[56] References Cited

U.S. PATENT DOCUMENTS

| | | | |
|---|---|---|---|
| 2,248,359 | 7/1941 | Klopfenstein | 362/119 |
| 2,376,448 | 5/1945 | Neugass | 362/120 X |
| 2,515,292 | 7/1950 | Carr | 362/119 X |
| 3,287,547 | 11/1966 | Spedding | 362/119 |
| 3,510,643 | 5/1970 | File | 362/119 |
| 4,302,797 | 11/1981 | Cooper | 362/109 X |

*Primary Examiner*—Larry Jones
*Attorney, Agent, or Firm*—E. Michael Combs

[57] ABSTRACT

First and second rigid handles pivotally mounted on a first side of a pivot axle are integral with respective first and second jaw rods. The first and second jaw rods include respective first and second resilient legs mounted exteriorly of the jaw rods in a diametrically opposed relationship relative to one another for engaging an interior surface of a broken bulb base. A lock flange is arranged to be received through a slot within the second leg, with the flange pivotally mounted to the first leg to secure the legs and the jaw rods in a predetermined spaced relationship relative to one another engaging the interior surface of the bulb base.

3 Claims, 4 Drawing Sheets

BROKEN LIGHT BULB BASE REMOVAL TOOL

BACKGROUND OF THE INVENTION

1. Field of the Invention

The field of invention relates to tool apparatus, and more particularly pertains to a new and improved broken light bulb base removal tool arranged to be received within a broken bulb base permitting ease of its removal.

2. Description of the Prior Art

Various tools are available in the prior art, wherein the U.S. Pat. No. 4,907,477 indicates the use of a tool structure for removing the base of a broken lamp from a socket formed with ribbed teeth directed exteriorly of one another.

The instant invention attempts to overcome deficiencies of the prior art by providing for a resilient engaging structure to prevent or minimize further debris from being displaced from the bulb base during its engagement in a removal and in this respect, the present invention substantially fulfills this need.

SUMMARY OF THE INVENTION

In view of the foregoing disadvantages inherent in the known types of tool apparatus now present in the prior art, the present invention provides a broken light bulb base removal tool wherein the same is arranged to securely engage an interior surface of a broken bulb base. As such, the general purpose of the present invention, which will be described subsequently in greater detail, is to provide a new and improved broken light bulb base removal tool which has all the advantages of the prior art bulb base removal tool structure and none of the disadvantages.

To attain this, the present invention provides first and second rigid handles pivotally mounted on a first side of a pivot axle integral with respective first and second jaw rods. The first and second jaw rods include respective first and second resilient legs mounted exteriorly of the jaw rods in a diametrically opposed relationship relative to one another for engaging an interior surface of a broken bulb base. A lock flange is arranged to be received through a slot within the second leg, with the flange pivotally mounted to the first leg to secure the legs and the jaw rods in a predetermined spaced relationship relative to on another engaging the interior surface of the bulb base.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved broken light bulb base removal tool which has all the advantages of the prior art tool apparatus and none of the disadvantages.

It is another object of the present invention to provide a new and improved broken light bulb base removal tool which may be easily and efficiently manufactured and marketed.

It is a further object of the present invention to provide a new and improved broken light bulb base removal tool which is of a durable and reliable construction.

An even further object of the present invention is to provide a new and improved broken light bulb base removal tool which is susceptible of a low cost of manufacture with regard to both materials and labor, and which accordingly is then susceptible of low prices of sale to the consuming public, thereby making such broken light bulb base removal tools economically available to the buying public.

Still yet another object of the present invention is to provide a new and improved broken light bulb base removal tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
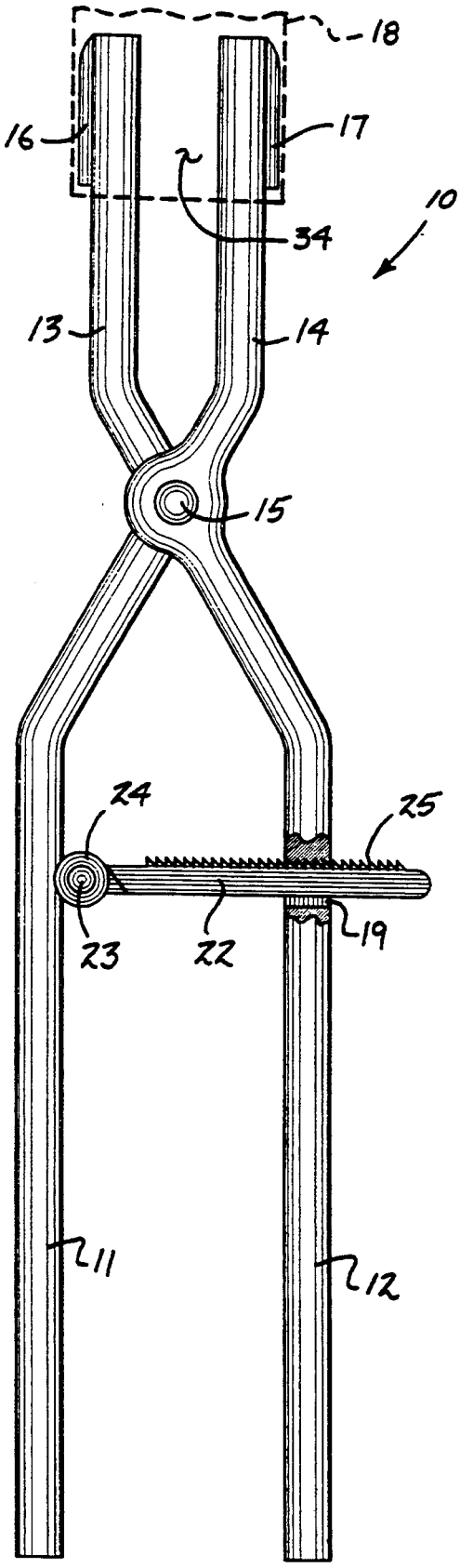
FIG. 1 is an orthographic view of the invention.
Figure 2:
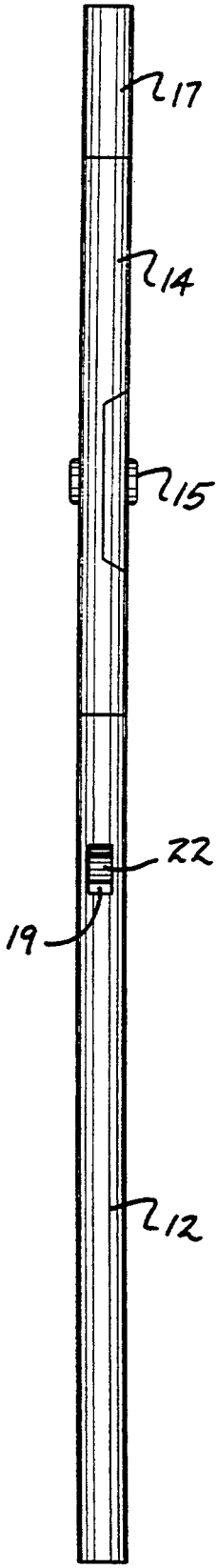
FIG. 2 is an orthographic end view of the invention.

With reference now to the drawings, and in particular to FIGS. 1 to 8 thereof, a new and improved broken light bulb base removal tool embodying the principles and concepts of the present invention and generally designated by the reference numerals 10 and 10*a* will be described.

Figure 3:
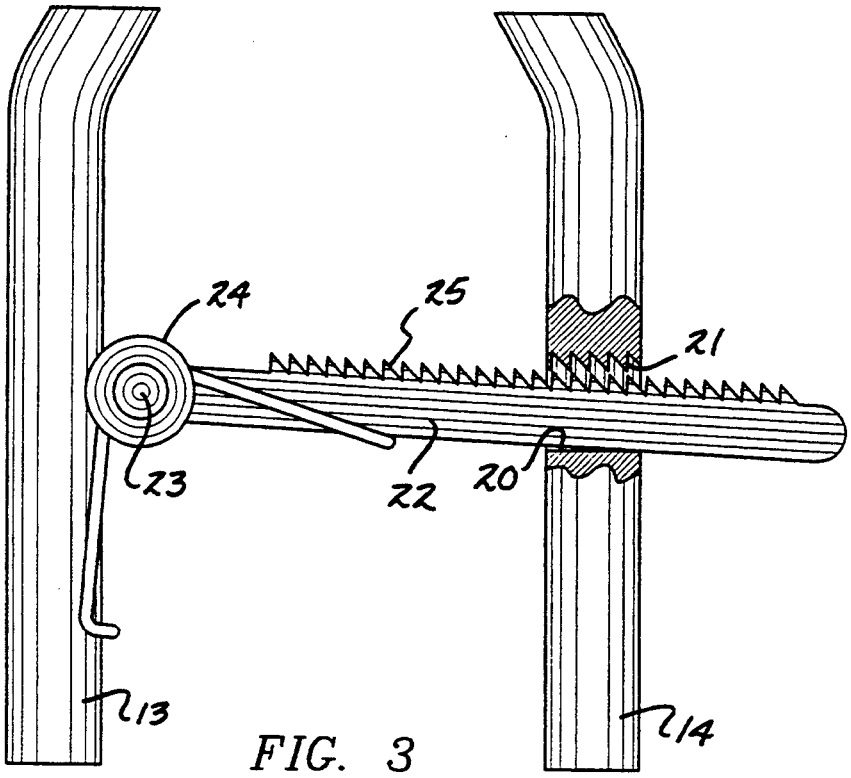
FIG. 3 is an enlarged orthographic view of the second handle slot.
Figure 4:
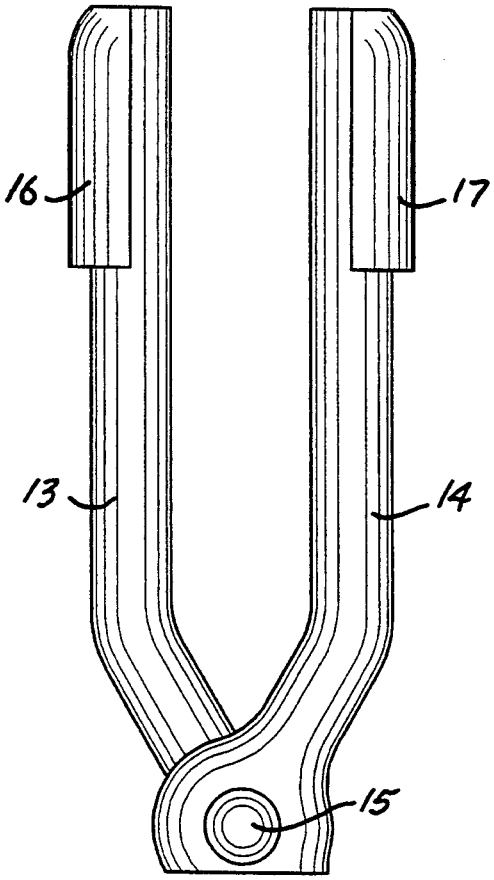
FIG. 4 is an orthographic view of the first and second jaw rods and the resilient engaging pads.

More specifically, the broken light bulb base removal tool 10 of the instant invention essentially comprises a first handle 11 mounted to a second handle 12 about a pivot axle with the first handle 11 directed into a first jaw rod 13 on an opposed side of the pivot axle relative to the first handle. Similarly, a second pivot jaw rod 14 fixedly mounted in adjacency to the second jaw rod is provided, such that the second jaw rod is integral with the second handle on an opposed side of the axle 15. The first and second jaw rods 13 and 14 are arranged for reception within a broken bulb base 18. A second leg slot 19 directed through the second leg receives a latch flange 22 therethrough. The slot 19 includes a smooth bottom wall 20 in facing relationship relative to a toothed top wall 21. The latch flange 22 is pivotally mounted about a flange axle 23, that in turn is secured 1o the first handle 11. A spring member 24 is provided mounted to the first handle wound about the flange axle 23 to bias the latch flange 22, and more particularly, a plurality of latch flange teeth 25 of a row of such teeth to complementarily receive the plurality of such teeth 25 within the tooth top wall 25 of the slot 19, as indicated in FIG. 3. In this manner, projection of the first and second jaw rods 13 and 14 within the bulb base 19 is provided until first and second resilient legs 16 and 17 fixedly mounted to the first and second jaw rods engage an interior surface of the bulb base. The first and second resilient legs 16 and 17 are fixedly mounted orthogonally oriented relative to the axle 15 diametrically opposed to a jaw rod gap 34 oriented between the first and second jaw rods 13 and 14. Subsequent to engaging the bulb base and its removal from an associated socket (not shown), release of the first and second jaw rods relative to the base 18 is effected by displacement of the latch flange teeth 25 from the slot top wall 21.

Figure 5:
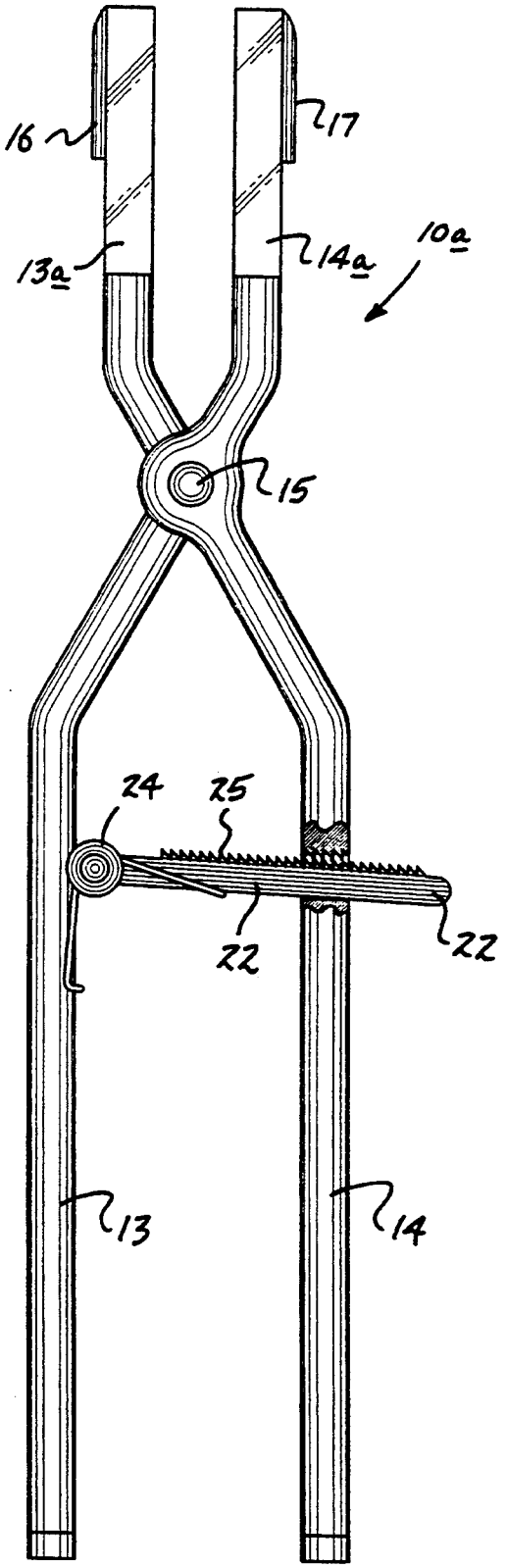
FIG. 5 is an isometric illustration of modified first and second jaw rods.
Figure 6:
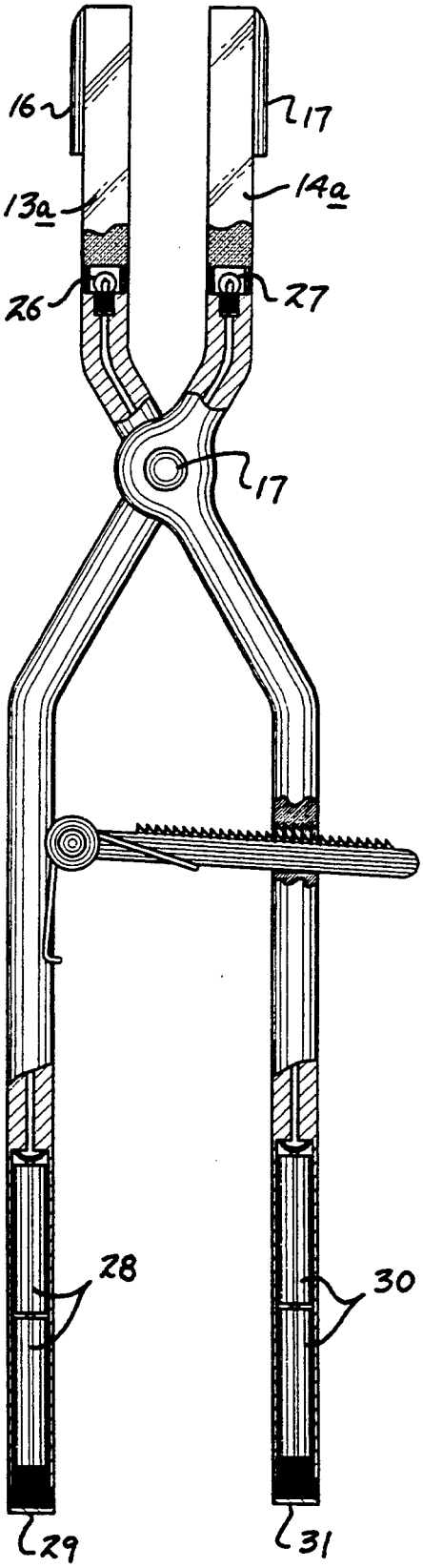
FIG. 6 is an orthographic view, partially in section, indicating various components of the tool structure as indicated in FIG. 5.

The FIGS. 5 and 6 indicate modified first and second jaw rods 13*a* and 14*a* formed of a transparent material, such that first and second illumination bulbs 26 and 27 are mounted within the first and second transparent jaw rods in electrical communication with respective first and second batteries 28 and 30 mounted within respective first and second handles 11 and 12. First and second cap switches 29 and 31 are mounted to free distal ends of respective first and second handles 11 and 12 to effect illumination of the first and second illumination bulbs 26 and 27 and accordingly direct such illumination through the transparent first and second jaw rods 13*a* and 14*a* respectively providing illumination within the bulb base 18 for enhanced ease of viewing and positioning of the jaw rods therewithin.

Figure 7:
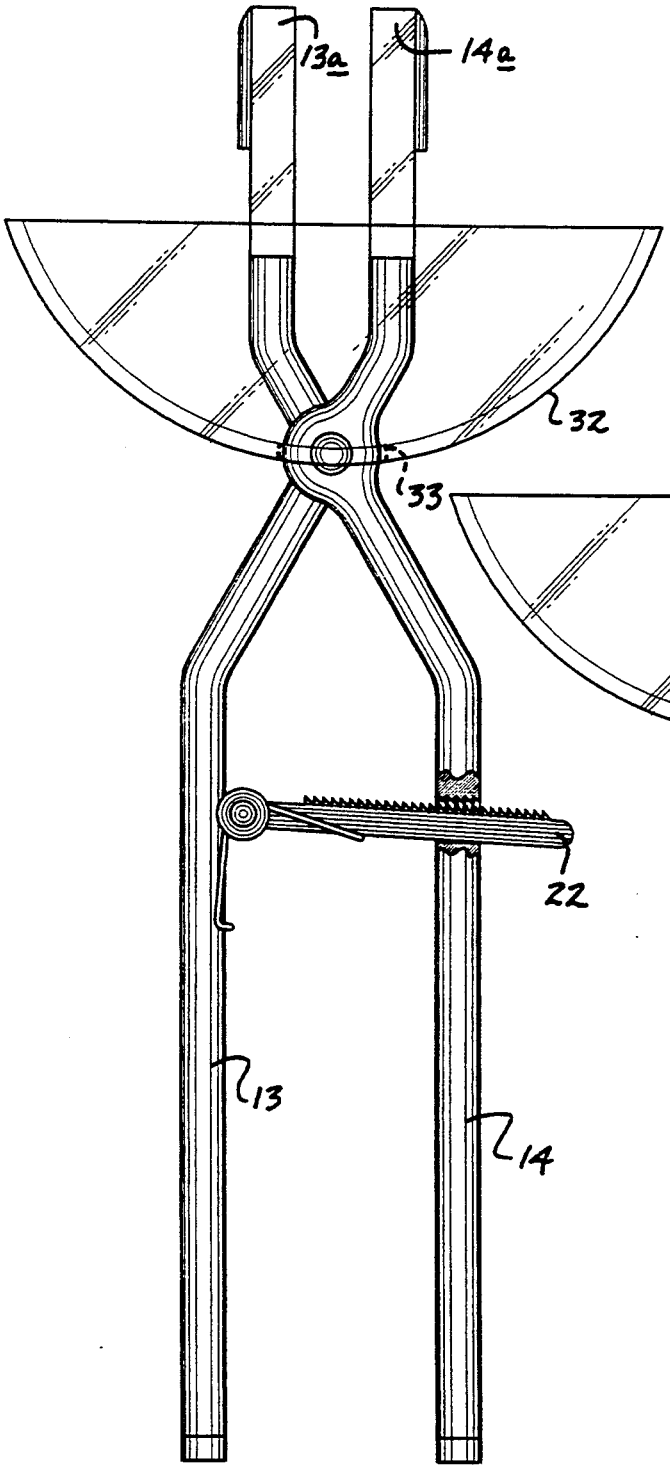
FIG. 7 is an orthographic view of the invention to further include a container bowl mounted to the tool structure.
Figure 8:
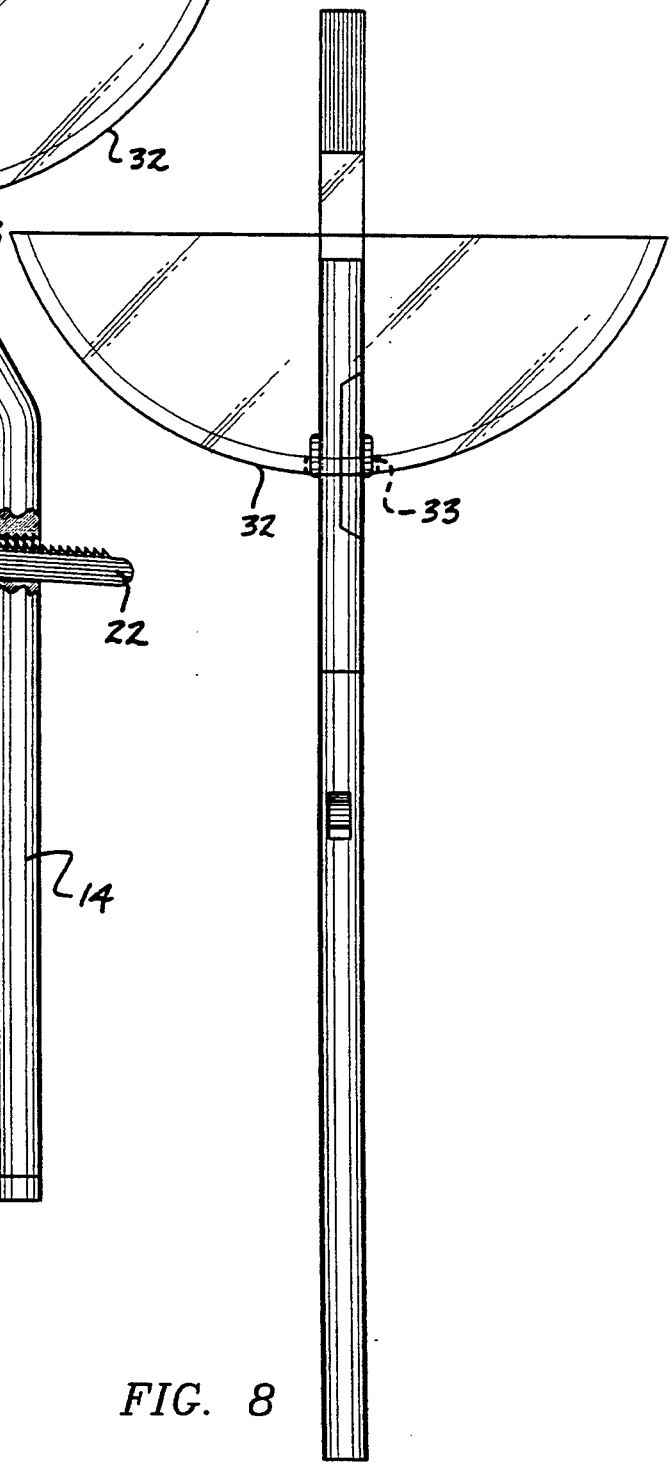
FIG. 8 is an orthographic end view of the container bowl mounted to the tool structure.

The FIGS. 7 and 8 indicates the use of a transparent semi-spherical bowl 32 having a resilient bowl opening perimeter 33 medially of the bowl to engage about the tool structure on opposed sides of the axle 15. In this manner, ease of viewing of illumination of the first and second transparent jaw rods 13*a* and 14*a* is available as the bowl structure 32 is formed of a transparent material. The bowl permits the capture of various debris received from the bulb base during its rotation, particularly within bulbs that are mounted within ceilings and the like directing such debris downwardly. Further, the resilient leg structure 16 and 17 minimizes the debris from falling from the bulb base due to the resilient nature of the leg structure 16 and 17 to cushion frictional engagement interiorly of the bulb base during securement by the tool structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted falling within the scope of the invention.

What is claimed as being new and desired to be protected by Letters Patent of the United States is as follows:

1. A broken light bulb base removal tool, comprising, a first rigid handle and a second rigid handle, a pivot axle pivotally mounting the first rigid handle and the second rigid handle, with a first jaw rod mounted to the first handle extending therefrom, and a second jaw rod extending from the second handle, with the pivot axle oriented between the first handle and the first jaw rod and the second handle and the second jaw rod, and a jaw rod gap oriented between the first jaw rod and the second jaw rod, with a first resilient leg mounted to an exterior surface of the first jaw rod diametrically opposed relative to the jaw rod gap, with a second resilient leg fixedly mounted to the second jaw rod diametrically opposed to the jaw rod gap, a slot directed through the second leg, with a latch flange having a flange axle pivotally mounting the latch flange to the first leg, the latch flange received through the slot and the slot having a smooth bottom wall and a toothed top wall, the latch flange having a row of flange teeth, with a plurality of such flange teeth arranged in complementary reception within the toothed top wall of the slot, and a spring member mounted between the first handle and the latch flange biasing the latch flange teeth into engagement with the toothed top wall.

2. A tool as set forth in claim 1 wherein the first jaw rod is transparent and the second jaw rod is transparent, and a first illumination bulb mounted within the first jaw rod, and a second illumination bulb mounted within the second jaw rod, and at least one first battery mounted within the first handle in communication with the first illumination bulb, and at least one second battery mounted within the second handle in electrical communication with the second illumination bulb, and a first switch member secured to the first handle to effect selective illumination of the first illumination bulb, and a second switch member mounted to the second handle to effect selective illumination of the second illumination bulb and thereby direct illumination through the first jaw rod and the second jaw rod respectively.

3. A tool as set forth in claim 2 including a semi-spherical transparent bowl mounted about the pivot axle, with the transparent bowl having a resilient bowl opening perimeter resiliently engaging the tool about the pivot axle.

* * * * *